United States Patent [19]

Matsui et al.

[11] Patent Number: 4,616,789

[45] Date of Patent: Oct. 14, 1986

[54] YARN END READYING DEVICE IN WINDER

[75] Inventors: Isamu Matsui, Kyoto; Hiroshi Uchida, Oumihachiman; Kazuo Nakanishi, Uji; Akira Shimano, Kyoto, all of Japan

[73] Assignee: Murata Kikai Kabushiki Kaisha, Japan

[21] Appl. No.: 541,096

[22] Filed: Oct. 12, 1983

[30] Foreign Application Priority Data

Oct. 13, 1982 [JP] Japan ..... 57-180464

[51] Int. Cl.[4] ..... B65H 54/20; B65H 54/22

[52] U.S. Cl. ..... 242/35.5 R; 242/35.5 A; 242/35.6 R

[58] Field of Search ..... 242/35.5 R, 35.5 A, 242/35.6 R, 35.6 E, 18 R

[56] References Cited

U.S. PATENT DOCUMENTS

| | | | |
|---|---|---|---|
| 2,675,971 | 4/1954 | Abbott | 242/35.6 R |
| 3,224,694 | 12/1965 | Oishi | 242/35.5 R |
| 3,381,908 | 5/1968 | Igushi et al. | 242/35.5 R |
| 3,471,101 | 10/1969 | Moyer et al. | 242/35.6 R |
| 3,480,216 | 11/1969 | Iannucci et al. | 242/35.6 R |
| 3,544,018 | 12/1970 | Stoppard et al. | 242/35.6 R |
| 3,727,852 | 4/1973 | Nelson et al. | 242/35.6 R |
| 3,850,378 | 11/1974 | Savio | 242/35.6 E X |
| 3,897,022 | 7/1975 | Savio | 242/35.6 E |
| 3,941,323 | 3/1976 | D'Agnolo et al. | 242/35.6 E X |

*Primary Examiner*—Stanley N. Gilreath

*Attorney, Agent, or Firm*—Spensley Horn Jubas & Lubitz

[57] ABSTRACT

A yarn end readying device for seeking and removing an end of yarn from a spinning cop. The cops are transported along a cop feeding line extended between a spinning frame and winding units of the winder being carried on carriers respectively. The yarn readying device includes a cop hanging mechanism and a yarn end readying mechanism for unwinding and cutting a starting end of the cop, cutting a tangled yarns and inserting the starting yarn end into a bore of a bobbin of the cop.

10 Claims, 18 Drawing Figures

YARN END READYING DEVICE IN WINDER

BACKGROUND OF THE INVENTION

The present invention relates to a yarn end readying device for seeking and removing an end of yarn from a spinning cop which is supplied to an automatic winder.

In an automatic winder having a plurality of winding units arranged in an array, it is usual that each winding unit is equipped with a cop magazine capable of storing a plurality of cops and of supplying a cop to the peg of the winding unit in response to the request of the winding unit for a cop. Such a cop magazine is supplied with cops manually by operators or automatically by a travelling cop supplying truck.

The applicant of the present invention proposed previously a cop supplying system designed to operate in a manner which is different from the above-mentioned cop supplying manner. According to the cop supplying system proposed previously by the applicant of the present invention, each winding unit of a winder is provided with no magazine, and a cop feeding line and an empty bobbin ejecting line are extended along the winding units. In operation, cops mounted on trays are transported along the cop feeding line, each cop is supplied to the yarn running position of each winding unit as mounted on the tray, the cop is subjected to winding operation as mounted on the carrier member and the empty bobbin is ejected from the winding unit as mounted on the tray after the yarn of the cop has been unwound.

SUMMARY OF THE INVENTION

The present invention relates to a yarn end readying device for seeking and removing an end of yarns wound on a cop to be employed in the cop supplying system, in which a cop feeding line and an empty bobbin ejecting line are extended along the winding units and cops are transported along the cop feeding line to the winding unit being carried on the trays. The readying device is provided on the cop feeding line betweend a fine spinning frame and winding units.

An object of the present invention is to provide a readying device for cops in which a starting end of yarn is sought and removed from the cop and a yarn end portion having a certain length is inserted into a bore of the bobbin of the cop.

In the yarn end readying device according to the present invention, cop hanging arms move along a vertical direction between a cop extracting position and a cop transporting position. The cop hanging arms extend radially from the rotatable shaft and each cop hanging arm has a gripper having an opening for receiving a cop therein. A starting yarn end removing and cutting means, a tangled yarn cutting means, a yarn end inserting means (including a yarn guide adapted to move along a vertical direction through a space between a suction mouth for sucking the yarn end and the cop), a cutter for cutting the yarn end lifted by the yarn guide and a suction mens for generating suction within the bobbin of the cop are disposed sequentially along the circular route of the grippers. Accordingly, the yarn end readying device according to the present invention is capable of inserting the yarn end sought and removed from the cop into the bobbin so as to suspend the yarn end from the top of the bobbin. Thus, the cop ejected from the yarn end readying device is transported to and supplied to the winder as mounted on the carrier and the yarn end blown upward at the yarn running position of the winding unit is held and guided securely to the knotter.

Furthermore, the yarn end readying device according to the present invention is provided with a mechanism capable of cutting the tangled portion of the starting yarn end and the finished end yarn of the cop. Accordingly, the starting yarn end of the cop is sucked by the suction mouth without fail, so that reliable yarn end readying operation is possible.

Still further, in the present invention it is capable of fitting a cop removed from the carrier carried along the cop feeding line on the same carrier after the cop has been processed through the yarn end readying processes. Thus, the application of the yarn end readying device to a cop supplying system makes possible cop conveying operation without requiring complicated cop conveying lines.

DETAILED DESCRIPTION OF THE INVENTION

A preferred embodiment of the present invention will be described hereinafter in connection with the accompanying drawings.

Figure 1:
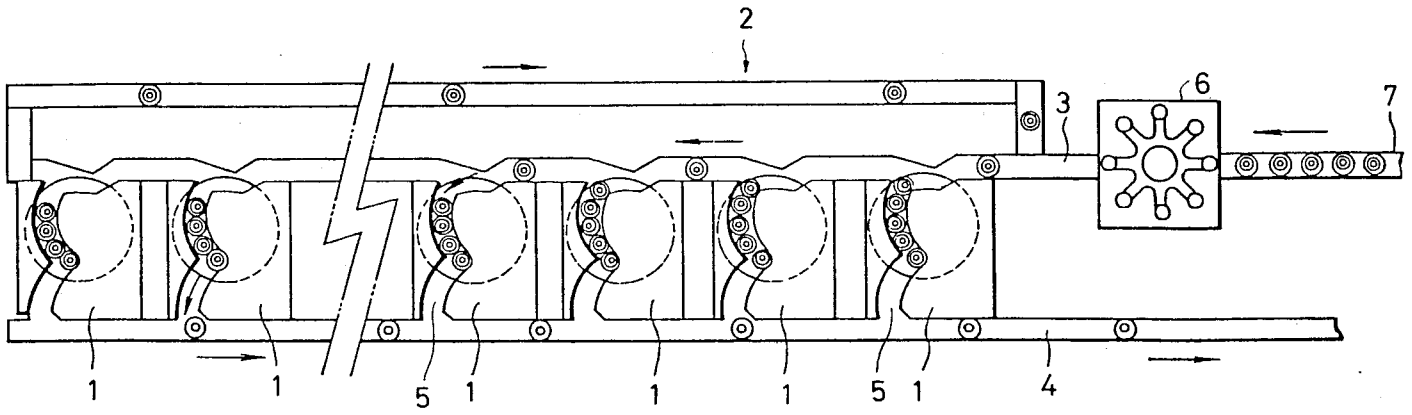
FIG. 1 is a representation of the layout of an exemplary cop supplying system for an automatic winder.

FIG. 1 shows a cop supplying system for an automatic winder, employing a yarn end readying device according to the present invention.

A cop feeding line 3 and a bobbin ejecting line 4 for transporting bobbin including empty bobbins and bobbins having residual yarn, each being formed, for example, of a belt conveyor, are extended along the array of a plurality of winding units 1 and on one side and on the other side, respectively, of an automatic winder 2. A carrier guiding line 5 extending between the cop feeding line 3 and the bobbin ejecting line 4 is formed at each winding unit. A yarn running position of the winding unit is situated within the carrier guiding line 5. A yarn end readying device 6 is disposed in the cop feeding line 3 on one longitudinal end of the winder. The yarn end readying device 6 seeks and removes the starting yarn end of a cop transported thereto, for example, from a fine spinning frame by a conveyor 7 and inserts a yarn end of a certain length into the bobbin of the cop.

Figure 2:
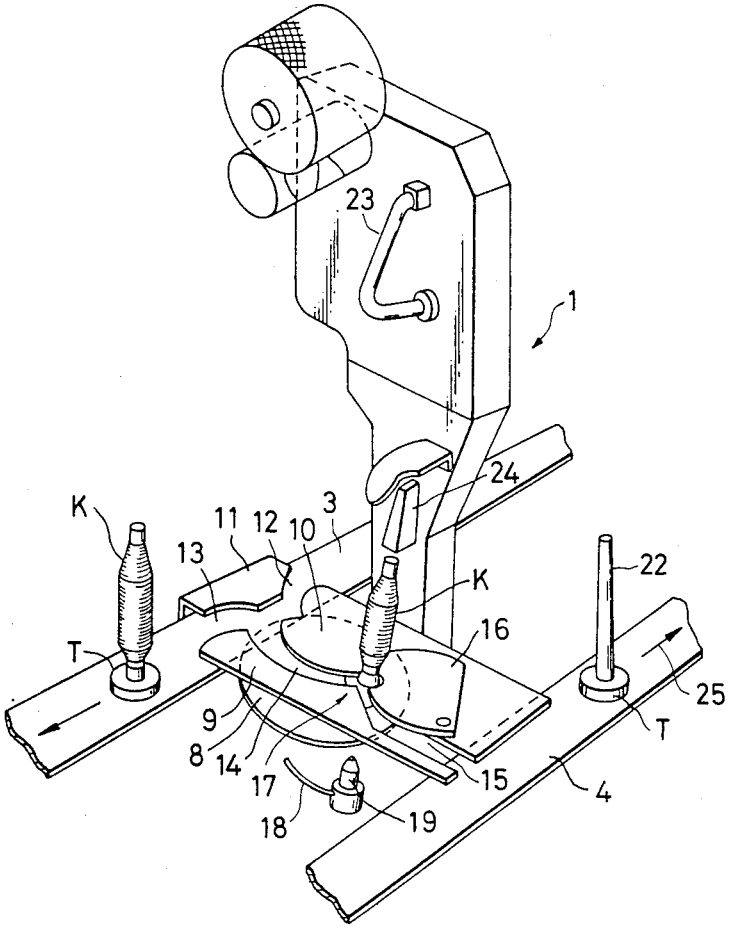
FIG. 2 is a schematic perspective view of an exemplary winding unit employed in the cop supplying system.
Figure 3:
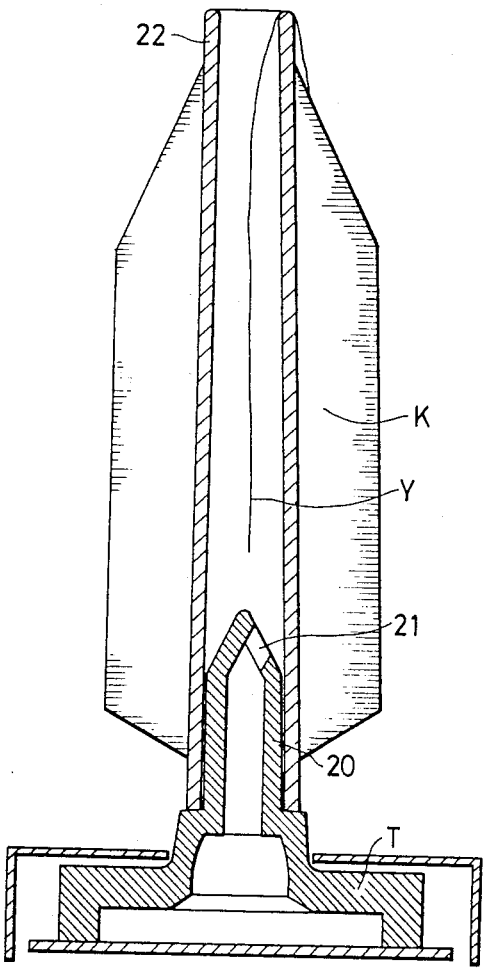
FIG. 3 is a sectional view of a cop with the yarn end portion suspended into the bobbin and a carrier carrying the cop thereon.

FIG. 2 shows an exemplary winding unit as described hereinbefore. In this winding unit, a cop is taken into the unit from the cop feeding line 3 by means of a rotary disk 8 and guides plate 9, 10 and 11. The rotary disk 8 declines slightly from the side of the cop feeding line 3 toward the side of the bobbin ejecting line 4. The guide plates 9 and 10 are fixedly disposed above the rotary disk 8 with a fixed space therebetween. The guide plates 10 and 11 form a cop inlet 12 and the guide plates 9 and 11 form a surplus cop exit 13. A cop reserve line 14 for storing a predetermined number of cops and a bobbin eject line 15 are formed between the guide plates 9 and 10. A swivel lever for removing a bobbin from the winding position and ejecting the same is indicated at 16. A compressed air jet nozzle 19 is disposed below the yarn running position 17. The compressed air jet nozzle 19 is connected through a conduit 18 to a compressed air source, not shown. Compressed air is jetted by the nozzle 19 through an arcuate slit, not shown, formed in the rotary disk 8 into the peg 20 of a tray T as shown in FIG. 3 and further into the bore of the bobbin 22 of the cop K through a hole 21 formed in the extremity of the peg 20 to blow the yarn end Y suspended in the bore of the bobbin 22 upward. The yarn end thus blown upward is sucked into and held by a relaying pipe waiting above the bobbin and is guided to a yarn knotter, which joins the yarn end removed from the cop and the yarn end of the winding package picked-out therefrom by a suction mouth. Balloon guide 24 guides the blown yarn end of the cop to the relaying pipe 23 and also controls the ballooning of the unwound yarn.

A cop being transported along the cop feeding line 3 is transferred through the cop inlet 12 onto the rotary disk 8 and is moved into the cop reserve groove 14. After a predetermined number of cops have been stored in the cop reserve groove 14, the successive cops are sent out through the surplus cop exit 13 to the next winding unit 1. Accordingly, unoccupied spaces in the cop reserve grooves are supplied automatically with cops while cops are circulated in the loop of the cop feeding line 3.

After a cop has been unwound completely at the yarn running position 17, the empty bobbin is removed from the yarn running position and is transferred through the bobbin eject groove 15 onto the bobbin ejecting line 4, and then is conveyed in the direction of the arrow 25 to the fine spinning frame.

A yarn end readying device as applied to the above-mentioned cop supplying system, to unwind the starting yarn end of a cop formed on a fine spinning frame and to insert the yarn end of a certain length into the bobbin of the cop, will be described hereinafter in connection with FIGS. 4 through 16.

Figures 4, 4A:
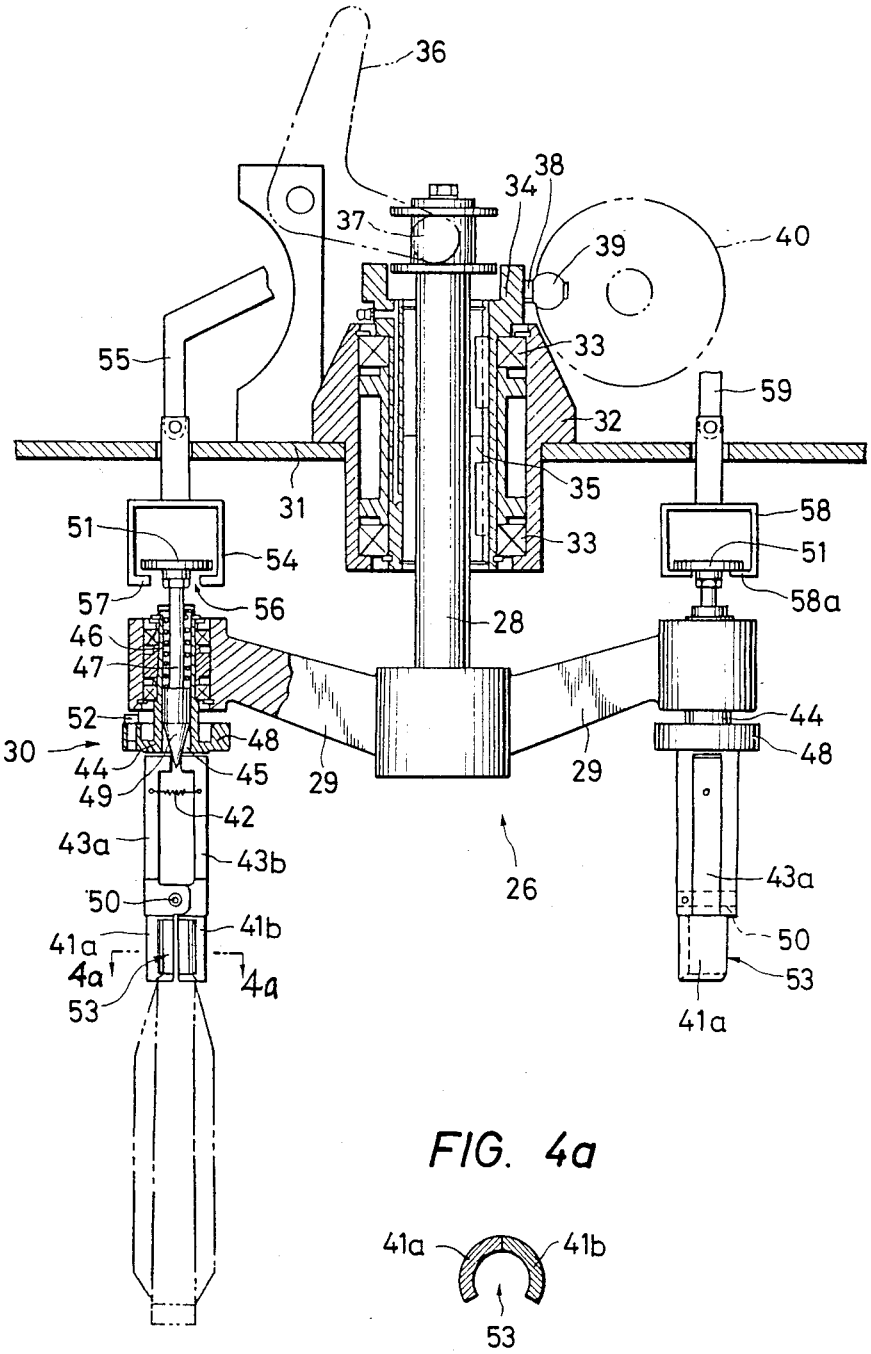
FIG. 4 is a partly sectional elevation of the cop hanging arms and the grippers of a yarn end readying device according to the present invention.
FIG. 4*a* is a sectional view of gripping fingers forming an opening taken along line 4*a*—4*a* of FIG. 4.
Figure 5:
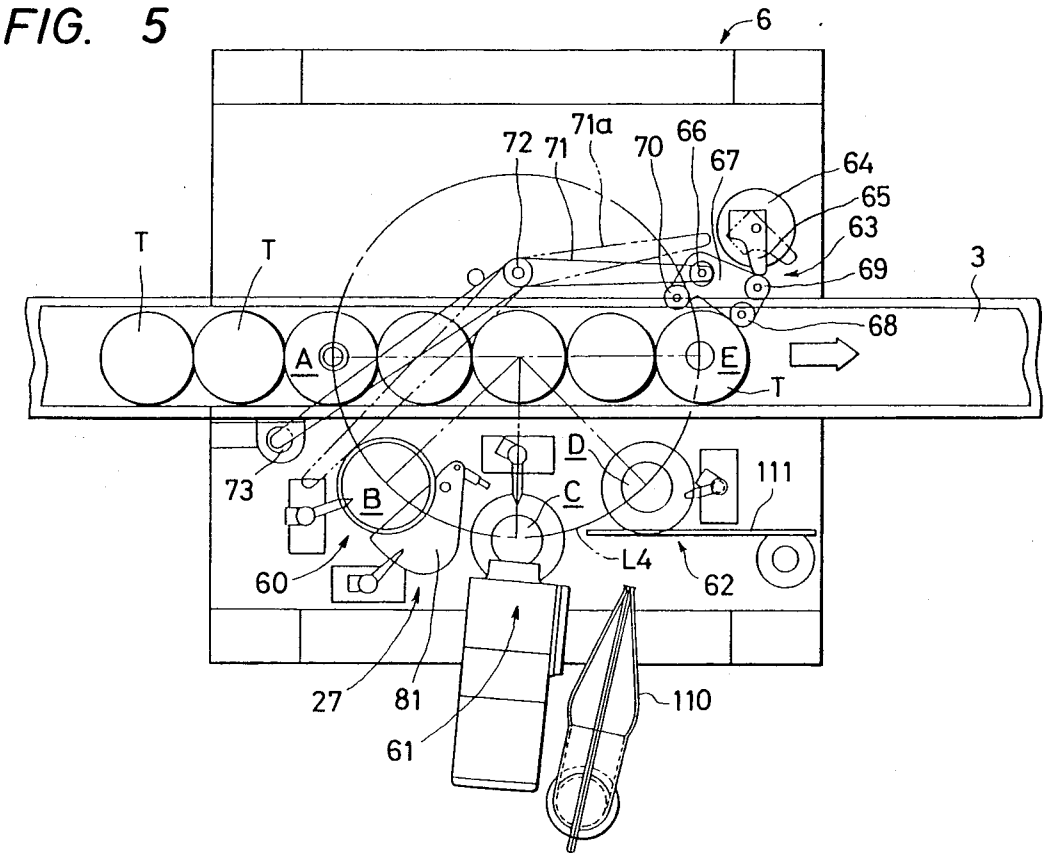
FIG. 5 is a plan view showing the layout of the yarn end adjusting mechanisms of the yarn end readying device.
Figure 6:
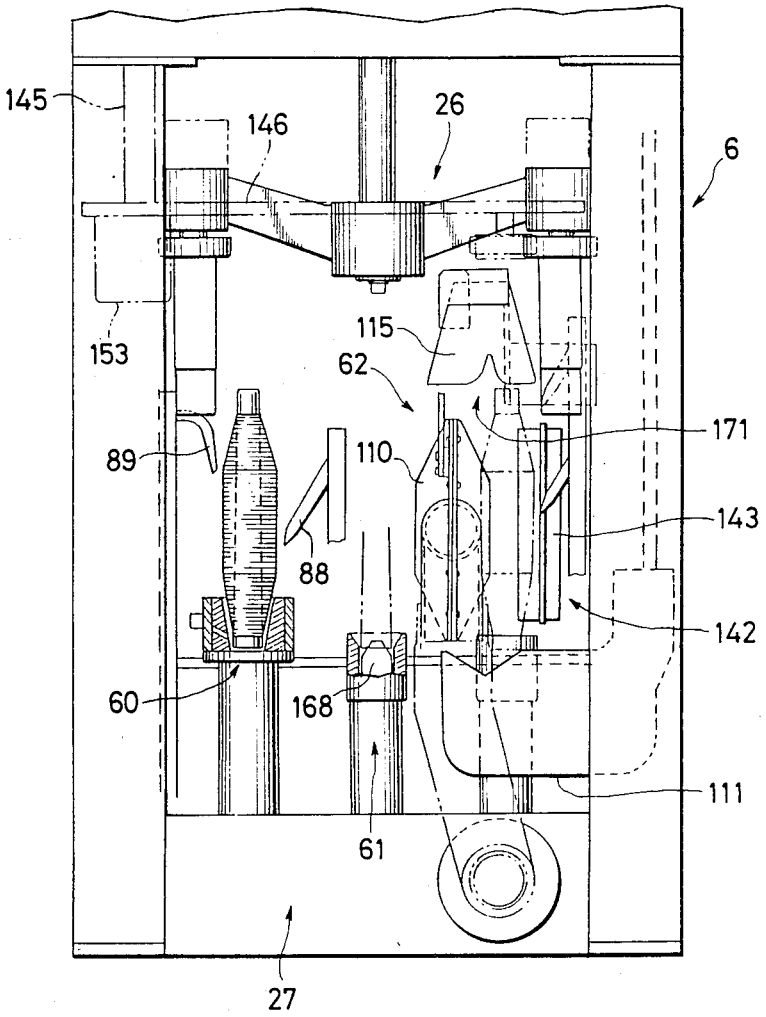
FIG. 6 is a schematic representation showing the general constitution of the yarn end readying device.
Figure 8:
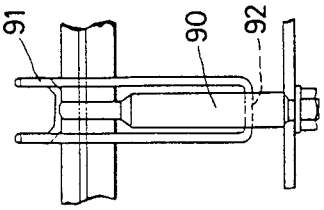
FIG. 8 is a side elevation of a clamping means employed in the starting yarn end removing and cutting means of FIG. 7.

Referring to FIGS. 4, 5 and 6, the yarn end readying device 6 comprises a cop hanging mechanism 26 shown in FIG. 4 and a yarn end readying mechanism 27 shown in FIG. 5. The cop hanging mechanism 26 is capable of moving vertically and rotating intermittently hanging a cop. The yarn end readying mechanism 27 readys yarn ends for winding. The cop hanging mechanism 26 and the yarn end readying mechanism 27 are disposed one over the other as shown in FIG. 6.

Referring particularly to FIG. 4, the cop hanging mechanism 26 has a plurality of cop hanging arms 29 extending radially from an intermittently rotatable shaft 28 and each having a cop gripper 30 hung from the free end thereof. The intermittently rotatable shaft 28 is fitted through and fixed to a spline sleeve 35 axially slidably fitted in a sleeve 34 journald through bearings 33 on a journal bearing 32 fixed to an upper frame 31. The cam follower 37 of a cam lever 36 is engaged with the upper end of the shaft 28. The shaft 28 is caused to slide up and down in accordance with the rocking motion of the cam lever 36. Shafts 38 are extended radially from the outer circumference of the sleeve 34 in one-to-one correspondence with the cop hanging arms 29. A roller 39 fixed to the free end of each shaft 38 engages a spiral groove formed in a cam drum 40, and thereby the shaft 28 is rotated intermittently through the sequential engagement of the rollers 39 corresponding to the hanging arms respectively as the cam drum 40 rotates.

The cop gripper 30 comprises a rotary member 44 having a pair of gripping arms 43*a* and 43*b* biased by a spring 42 so that the fingers 41*a* and 41*b* formed at the lower end of the gripping arms 43*a* and 43*b* respectively are urged to move away from each other, and a wedging rod 47 disposed in the bore 45 of the rotary member 44 and biased downward by a spring 46. A touch roller, which will be described afterward, is placed in contact with the flange 48 of the rotary member 44 to rotate integrally the rotary member 44 and the gripping arms 43*a* and 43*b*. The gripping arms 43*a* and 43*b* swing on a pivot 50 so that the fingers 41*a* and 41*b* approaches each other when the wedge head 49 of the wedging rod 47 enters the gap between the gripping arms 43*a* and 43*b*, while the gripping arms 43*a* and 43*b* are caused to swing by the spring 42 so that the fingers 41*a* and 41*b* move away from each other, when a flange 51 attached to the upper end of the wedging rod 47 is pulled up against the resilient force of the spring 46. A pin fixed to the rotary member functions to locate the opening 53 formed between the fingers 41*a* and 41*b* as shown in FIG. 4*a*, in inserting a yarn end into a bobbin, the procedure of which will be described afterward.

A cop chucker 54 is disposed at the cop chucking position of the cop hanging arm 29, namely, at a position on the entrance side of the yarn end readying device and is hung from a lever 55 adapted to be moved vertically by a cam plate, not shown. The cop chucker 54 has a slit for receiving the rod 47 of the cop gripper 30 therethrough and a catching part 57 which engages the flange 51. The cop chucker 54 controls the wedging rod 47. An opener 58 of the same construction as the cop chucker 54 is disposed at a cop fitting position where a cop is fitted on a carrier, namely a position on the exit side of the yarn end readying device. The opener 58 is pivotally joined to a lever 59 which is controlled by another cam for vertical motion, for cop fitting operation.

Eight cop hanging arms 29 are provided and the intermittently rotatable shaft 28 is rotated intermittently through an angle of 45°. The cop hanging arms 29 are lowered at each angular position for readying a yarn end.

The yarn end readying mechanism 27 as shown in FIGS. 5 and 6 is disposed below the cop hanging arms 29. A starting yarn end unwinding and cutting mechanism 60 for unwinding and cutting the starting yarn end wound round the bottom part of the bobbin of a cop is disposed at a position B spaced angularly from a cop chucking position A by an angle of 45°; a tangled yarn cutting mechanism 61 for cutting the tangle of the unwind starting yarn end and the finished end yarn of the cop is disposed at a position C spaced angularly from the position A by an angle of 90°; and a yarn end inserting mechanism 62 for cutting the unwound starting yarn end in a certain length and inserting the same from the upper end into the bobbin of a cop is disposed at a position spaced angularly from the position A by an angle of 135°.

As shown in FIG. 5, the cop feeding line 3 extends through the yarn end readying device 6, passing directly below the intermittently rotatable shaft. In this embodiment, a tray is used as the carrier. The trays T are transported by the conveyor of the cop feeding line 3. A stopping mechanism 63 disposed on the exit side of the yarn end readying device stops the trays T conveyed by the belt conveyor and dispenses the trays. The stopping mechanism 63 comprises a cam plate 65 adapted to be moved between two positions by a rotary solenoid 64, a rocking plate 67 adapted to rock on a fixed shaft 66 following the movement of the cam plate, a cam follower 69 supported on the rocking plate 67 and stop rollers 68 and 70. The stopping mechanism 63 stops and reserves the trays on the conveyor of the cop feeding line 3. The outside diameter of the tray T and the radius of rotation of the cop hanging arm 29 are so determined that five trays are arranged exactly between the positions A and E. A cop removed from a tray at the cop chucking position A is fitted on the same tray at the exit position E, so that the one-to-one relation between a cop and a tray is maintained.

That is, D (distance between A and E) which is a diameter of locus L4 of the rotation of the hanging arm 29, and the diameter d of the carrier or tray T, have the following relation:

$$D=d(n-1),$$

in which n represents a number of carriers arranged between A and E and the number of hanging arms N is determined according to the equation, $$N=2(n-1).$$

As shown in FIG. 5, a safety lever 71 is pivotally supported on a fixed shaft 72 for turning in a horizontal plane extending slightly above the head of the peg of the tray (FIG. 3) placed on the conveyor of the cop feeding line 3. Normally, the safety lever 71 stays in a position illustrated by continuous lines with one end thereof located above a proximity sensor 73 and functions in the following three occasions: when a tray carrying a cop advances from the position A due to failure in removing the cop from the tray at the position A, when a cop is removed from a tray at the position A and yet the cop is hung improperly, and when a cop turns past the exit position as hung from the cop hanging arm as the cop hanging arm is turned intermittently, due to failure in fitting the cop on the corresponding tray at the position E. In such occasions, the cop is brought into collision against the safety lever 71 to turn the safety lever to a position 71*a* illustrated by two dotted and chain lines, and thereby the proximity sensor 73 is actuated to disconnect the driving source of the yarn end readying device 6.

Each means of the yarn end readying mechanism 27 will be described hereinafter.

(a) Starting yarn end unwinding and cutting means

Figure 9:
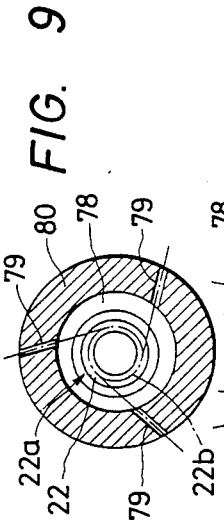
FIG. 9 is a cross sectional view of a starting yarn end unwinding nozzle.
Figure 7:
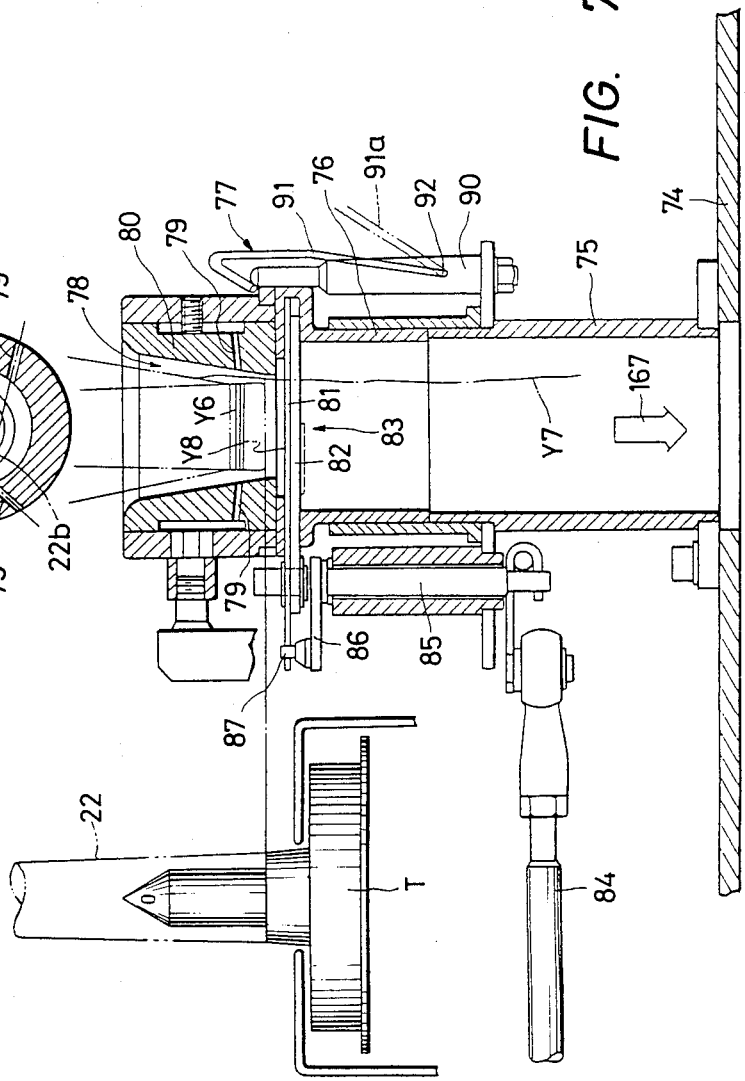
FIG. 7 is a sectional front elevation of a preferred embodiment of a starting yarn end unwinding and cutting means of the yarn end readying device according to the present invention.

Referring to FIG. 7, a cylindrical column 75 is fixedly placed on a fixed frame 74 and a starting yarn end sucking pipe 76 is mounted on the cylindrical column 75 and fastened thereto by means of clamps 77. The starting yarn end sucking pipe 76 has a cylinder 80 having a cop receiving hole 78 and a fluid jet nozzle 79, and a cutter 83 comprising a movable blade 81 which swivels across the starting yarn end sucking pipe 76 and a stationary blade 82. A suction duct is connected to the cylindrical column 75. The movable blade 81 is moved through a rod 84 controlled by a cam of the yarn end readying device, a shaft 85 and a lever 86 by a pin 87 attached to the lever 86, in a direction perpendicular to the plane of the sheet. When turned to a yarn cutting position as shown in FIG. 5, the movable blade 81 covers up the bore of the starting yarn end sucking pipe 76 to interrupt the yarn end sucking action thus preventing the excessive unwinding of the yarn end. As shown in FIG. 7, the fluid jet nozzle 79 for unwinding a starting yarn end is disposed so as to jet a fluid slightly downward and, as shown in FIG. 9, so as to jet a fluid along a tangent to an imaginary circle 22*b* existing inside of the outer circumference 22*a* of a bobbin 22 where the starting yarn end is wound, in order that the fluid will act on the starting yarn end so that the yarn end is removed from the outer circumference of the bobbin for improved unwinding. Fluid jet nozzles 88 and 89 shown in FIG. 6 are provided to blow the starting yarn end wound around the surface of a cop toward the starting yarn end sucking pipe located thereunder. The clamp 77 shown in FIGS. 7 and 8 consists of a shaft 90 and a spring hook 91 attached to the shaft 90. The spring hook 91 is swingable on a pivotal part 92. A plurality of the clamps 77 are distributed around the cylindrical column 75. The starting yarn end sucking pipe 76, the cutter 83 and the cylinder 80 can integrally be extracted from the cylindrical column 75 by turning the spring hook 91 of each clamp 77 to a position illustrated by two dotted and chain lines, and thereby the starting yarn end sucking pipe 76, the cutter 83 and the cylinder 80 can be replaced with other ones of different designs which are suitable to the kind of cops to be treated.

(b) Tangled yarn cutting means

Figure 11:
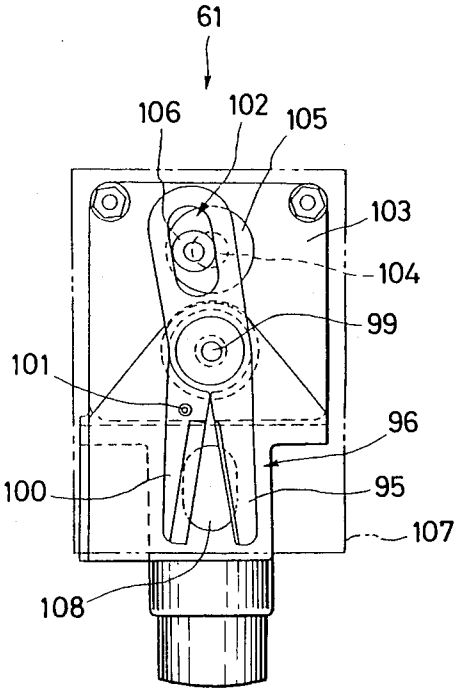
FIG. 11 is a front elevation of the tangled yarn cutting means of FIG. 10.
Figure 10:
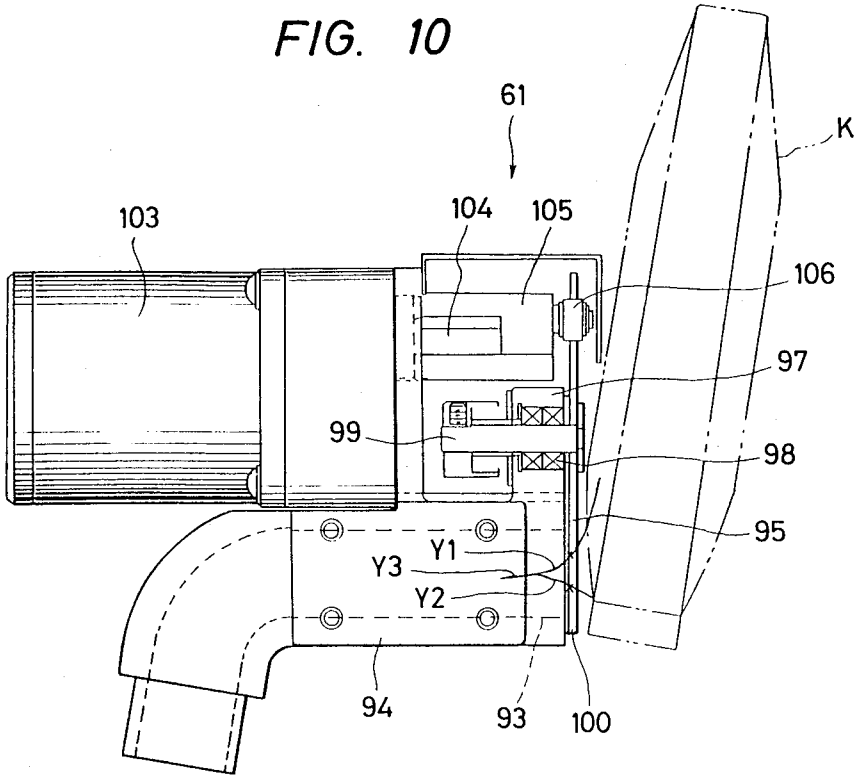
FIG. 10 is a partly sectional side elevation of a preferred embodiment of a tangled yarn cutting unit of the yarn end readying device according to the present invention.

Referring to FIGS. 10 and 11, a suction pipe 93 is fixed to a frame 94 at a position, where the suction pipe 93 is situated adjacently to the lower end of a cop K located at the lower position. A cutter 96 having a movable blade 95 capable of reciprocating across the opening of the suction pipe 93 is disposed at the opening of the suction pipe 93. A fixed blade 100 is mounted on a shaft 99 supported in bearings 98 fitted in a fixed bearing block 97 and is restrained from rotation by a screw 101, while the movable blade 95 is fixedly mounted on the shaft 99. A roller 106 provided eccentrically on the end surface of a rotary member 105 fixed to the shaft 104 of a motor 103 is received in a slot 102 formed in the upper end of the movable blade 95. Accordingly, the movable blade 95 is rocked right and left on the shaft 99 as viewed in FIG. 11, through the roller 106 by the motor 103.

Accordingly, in case the unwound starting yarn end Y1 and the finished end yarn Y2 of the cop are tangled, the tangled yarn Y3 is sucked by the suction pipe 93 as the lower part of the cop is brought near to the suction pipe 93 and is cut off by the cutter 96 working at the opening of the suction pipe 93, so that the finished end yarn Y2 and the starting yarn end Y1 are separated. A cover 107 having a hole 108 corresponding to the opening of the suction pipe is provided to prevent damaging the yarn layer of the cop.

(c) Yarn end inserting means

Figure 12:
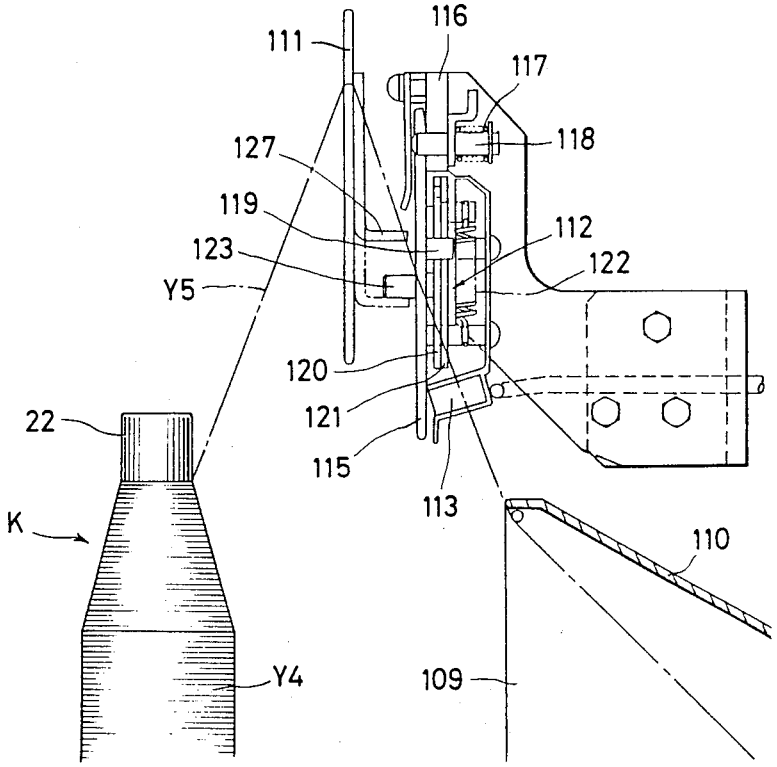
FIG. 12 is a segmentary side elevation of a yarn end inserting means of the yarn end readying device according to the present invention, showing the relation between the yarn guide which moves along a vertical direction through a space between the suction mouth and a cop, and the cutter.
Figure 13:
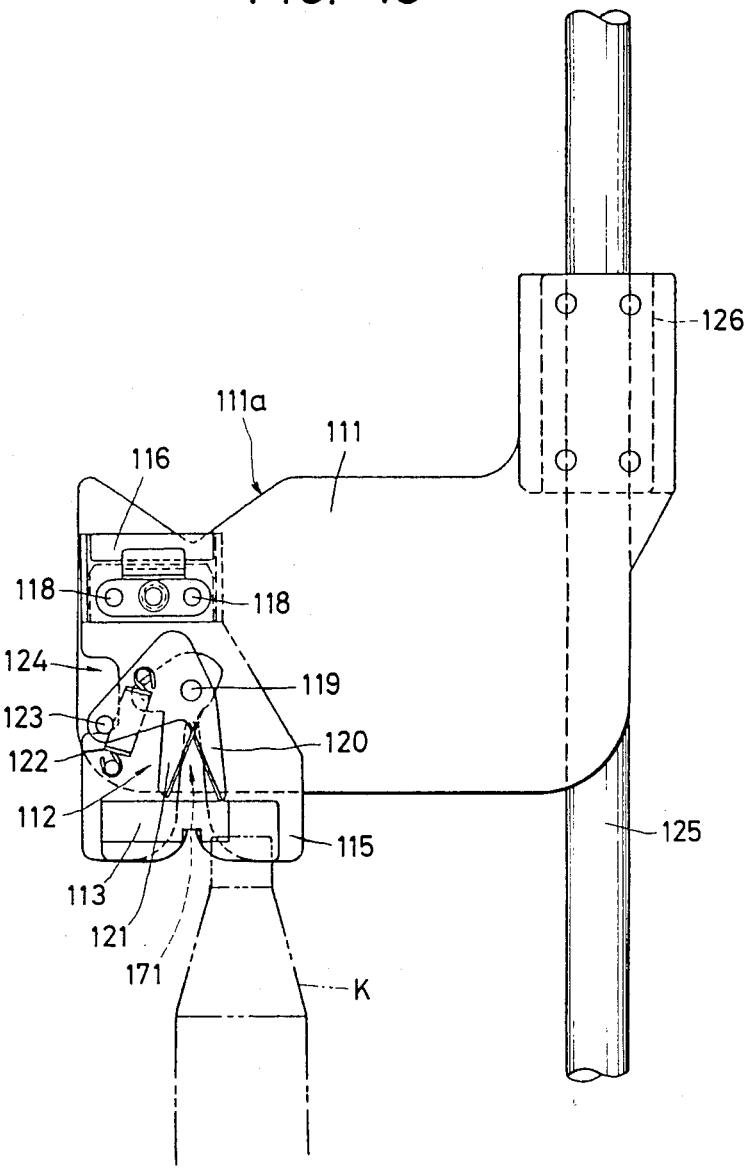
FIG. 13 is a fragmentary front elevation of the yarn end inserting means of FIG. 12.

Referring to FIGS. 12 and 13, the yarn end inserting mechanism 62 comprises a suction mouth 110 having a slit 109 of a length practically the same as the length of the yarn layer Y4 of a cop and adapted to move toward and away from the surface of the yarn layer, a yarn guide 111 for holding and lifting the yarn Y5 extending between the cop K and the suction mouth 110, a cutter 112 for cutting the lifted yarn in a certain length, a yarn feeler 113, and a yarn end sucking mechanism 114 (FIG. 15) for generating an air stream to suck the yarn end into the bobbin.

The cutter 112 and the yarn feeler 113 are attached to a guide plate 115 having a slit widening downward and the guide plate 115 is detachably supported on a bracket 116 attached to a fixed frame. The guide plate 115 is fixed to the bracket by pins 118 biased by springs 117 respectively.

The cutter 112 comprises a movable blade 120 rotatably mounted on a shaft 119 and a fixed blade 121. The movable blade 120 is urged counterclockwise, namely, in an opening direction, by a spring 122. A pin 123 is fixed to the movable blade 120 so as to project from the surface of the movable blade 120 toward the yarn guide 111. The movable blade 120 waits for operation with the pin 123 situated within the recess 124 of the guide plate 115 and in abutment with the lower surface of the recess.

Figure 14:
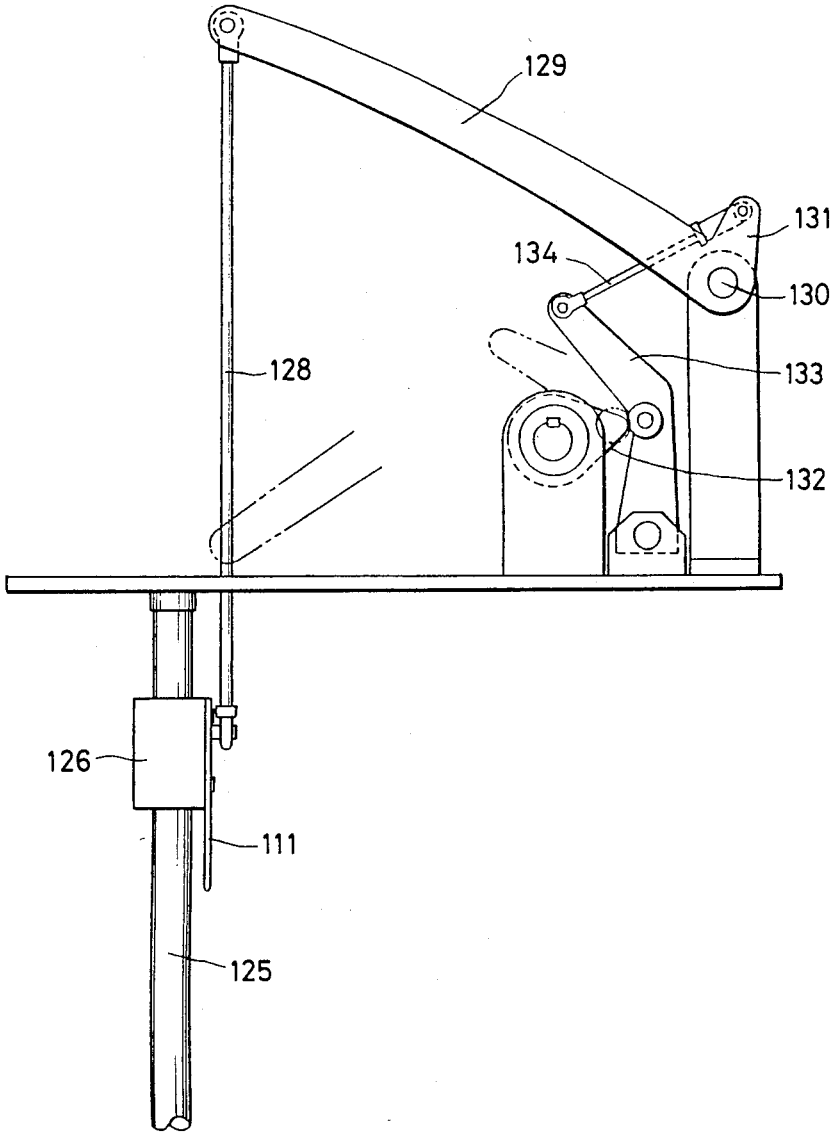
FIG. 14 is a side elevation of means for raising and lowering the yarn guide.

The yarn guide 111 is fixed to a slider 126 capable of moving vertically along a fixed post 125, for vertical movement between the cop K and the suction mouth 110. A guide groove 111*a* is formed in the upper edge of the yarn guide 111. An L-shaped actuator 127 which engages the pin 123 of the movable blade 120 is fixed to the yarn guide on the surface facing the cutter. In rest position, the yarn guide 111 is positioned with the upper edge thereof situated below the lower end of the cop, while in the raised position, the yarn guide is positioned with the upper edge thereof situated above the upper end of the cop as shown in FIG. 12. Thus, the yarn guide 111 is reciprocated through a long stroke by a mechanism, for example, as shown in FIG. 14.

A rod 128 is connected at the lower end to the slider 126 and at the upper end to a long lever 129 pivotally supported on a fixed shaft 130. A rod 134 is connected at one end thereof to the arm 131 of the long lever 129 and at the other end to a cam lever 133 adapted to be rocked by a cam 132. The throw of the cam 132 is magnified by the cam lever 133 and the long lever 129. The vertical motion of the slider may be given by a chain mechanism.

Figure 15:
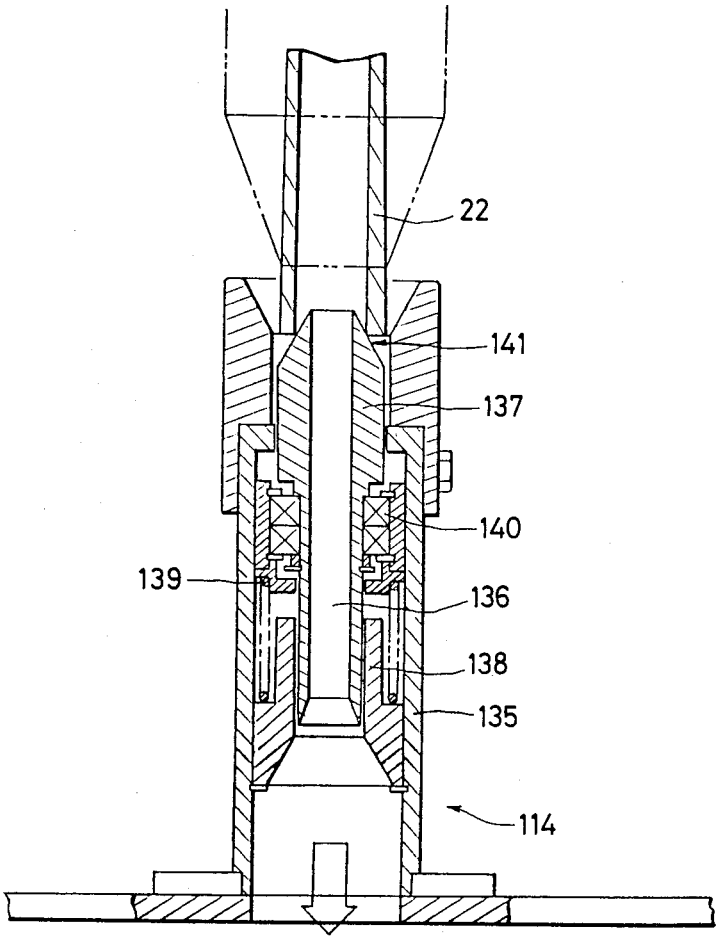
FIG. 15 is a sectional view of a preferred embodiment of a suction device for generating suction stream within the bobbin of a cop.

FIG. 15 shows a yarn end sucking mechanism 114 capable of generating a suction air current within the bobbin of a cop located at the yarn end inserting position. A cop supporting member 137 having a central through hole 136 is provided rotatably and vertically movably within a suction cylinder 135 connected to a suction pipe, not shown. The truncated cone-shaped upper end of the cop supporting member 137 enters the bore of the bobbin 22 to support the lower part of the cop at a fixed position. The cop supporting member 137 is supported rotatably in bearings 140 within the suction cylinder 135 and is guided for vertical movement by a guide tube 138. A spring 139 biases the cop supporting member 137 upward.

When a cop hung from the cop hanging arm is lowered to bring the inner circumference of the bobbin 22 into close contact with the conical surface 141 of the cop supporting member 137, a suction air stream flows efficiently through the bore of the bobbin.

Figure 16:
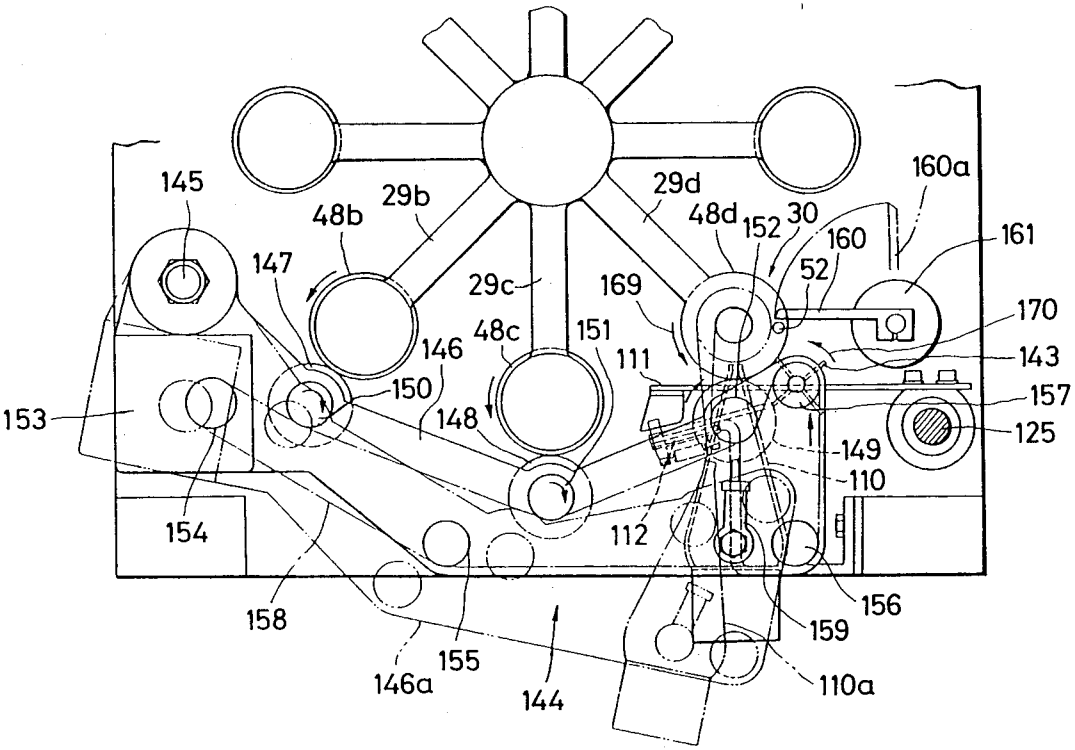
FIG. 16 is a plan view of a touch roller mechanism for rotating cops located at the yarn readying positions respectively.

Furthermore, a beater 142 is provided to facilitate separating the yarn end adhering to the surface of the yarn layer of a cop located at the yarn end inserting position, as shown in FIGS. 6 and 16. The beater 142 is provided with blades 143 and is supported in place for rotation in a direction to unwind the yarn end. The suction mouth 110 and the beater 142 are mounted on a swivel bracket together with a touch roller mechanism, which will be described afterward, so as to be moved toward and away from the cop.

In the yarn end readying mechanism described hereinbefore in connection with the paragraphs (a), (b) and (c), the cop is rotated in a yarn end unwinding direction. The touch roller mechanism 144 for rotating the cop in such a direction will be described hereunder in connection with FIG. 16.

A swivel arm 146 is mounted pivotally on a shaft 145 fixed to a frame. Touch rollers 147, 148 and 149 are fixed, on the lower side of the swivel arm 146, to rotary shafts mounted rotatably on the swivel arm 146 respectively. Pulleys 150, 151 and 152 are fixed, on the upper side of the swivel arm 146, to the rotary shaft respectively. An endless belt 158 is extended between the shaft 154 of a motor 153 mounted on the arm 146, guide pulleys 155, 156 and 157 mounted rotatably on the arm 146 and the pulleys 150, 151 and 152 fixed to the shafts of the touch rollers respectively.

When the arm 146 is located at a position illustrated by solid lines in FIG. 16, the touch rollers 147, 148 and 149 are in touch with the flanges 48*b*, 48*c* and 48*d* of the rotary members hung from the corresponding cop hanging arms 29*b*, 29*c* and 29*d* and the motor 153, when actuated, drives the rotary members, hence, the cops gripped by the grippers, through the frictional contact between the touch rollers 147, 148 and 149 and the corresponding flanges 48*b*, 48*c* and 48*d*. When the arm 146 is moved to a position illustrated by two dotted and chain lines, the touch rollers 147, 148 and 149 are separated from the flanges 48*b*, 48*c* and 48*d*. The swivel motion of the swivel arm 146 is controlled through a rod 159 connected thereto by a cam, not shown. The suction mouth 110 and the beater 142 are supported on the swivel arm 146 and are moved toward and away from the cop located at the position D simultaneously with the advancement and the retraction of the swivel arm 146.

Referring again to FIG. 16, a locating member 160 for locating the cop gripper 30 at the yarn end inserting position is moved between two positions by a rotary solenoid 161 or a cam mechanism. When at a position illustrated by solid lines, the locating member 160 engages the pin 52 fixed to the flange 48 of the rotary member hung from the cop hanging arm, to locate the opening 53 formed between the fingers 41*a* and 41*b* (FIG. 4*a*) at a position opposite the cutter 112 so that the adjusted yarn end is allowed to be securely sucked into the bore of the bobbin through the opening 53.

The manner of operation of the yarn end readying device thus constituted will be described hereunder.

(a) Cop chucking process

Figure 17:
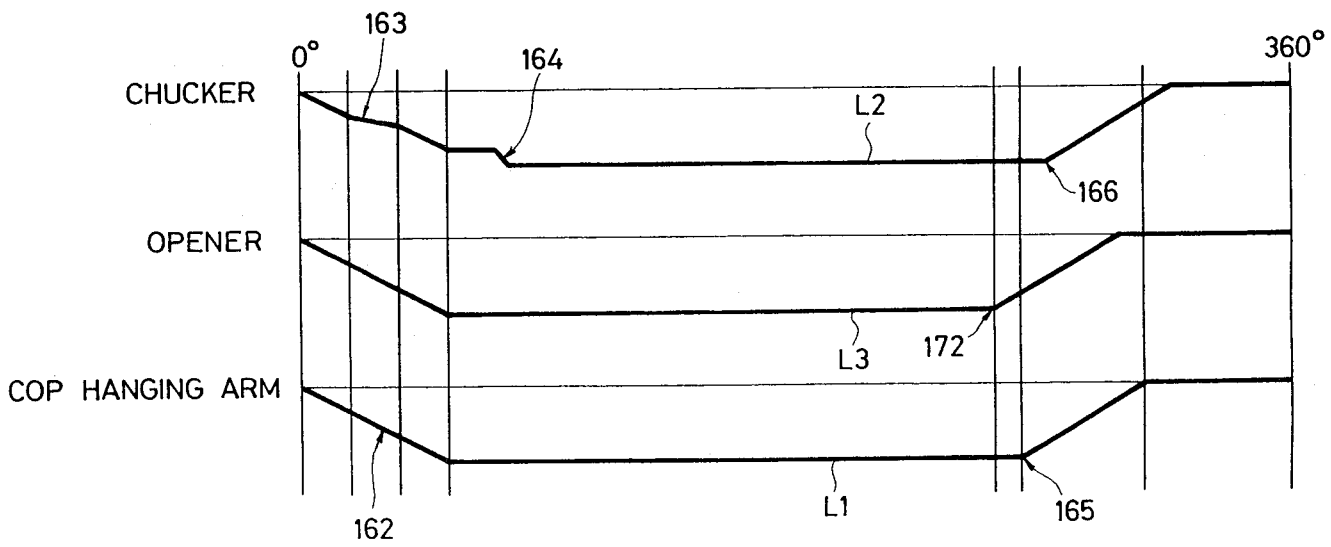
FIG. 17 is a timing diagram showing the relation between the respective up-and-down motions of the cop hanging arm, the chucker and the opener.

Referring to FIG. 5, a cop carried on a tray T conveyed to the yarn end readying device by the conveyor of the cop feeding line 3 is gripped at the cop chucking position A by the gripper and is removed from the peg of the tray. Referring to FIGS. 4 and 17, while the intermittently rotatable shaft 28 is stopped, the lever 36 is actuated to lower the shaft 28, and hence the gripper 30 moves downward to the cop. At the same time, the chucker 54 also starts moving downward. As shown in FIG. 17, the descending speed of the gripper 30 is constant throughout the downward movement thereof, whereas the descending speed of the chucker 54 is reduced at a point 163. Consequently, the flange 51 fixed to the upper end of the wedging rod 47 engages the catching part 57 of the chucker 54 due to the difference between the descending speed of the gripper 30 and that of the chucker 54, so that the wedge head 49 is raised relatively to the rotary member 44, and thereby the gripping arms 43*a* and 43*b* are caused to approach each other by the spring 42. Thus the gripping fingers 41*a* and 41*b* have been opened before the gripper 30 arrives at the bottom position, therefore, the top of the bobbin of the cop is received between the gripping fingers 41*a* and 41*b* upon the arrival of the gripper 30 at the bottom position. Upon the delayed arrival of the chucker 54 at its bottom position, the flange 51 is released from the catching part 57, hence, the gripping fingers are closed to grip the cop. At this time, namely, when the cop hanging arms are at the lower position, the cops located at the positions B, C and D are subjected to the corresponding yarn readying actions respectively and the cop located at the position E is fitted again on the tray.

As shown by lines L1 and L2 in FIG. 17, in raising the cop hanging arm 29, the starting timing (point 166) of the chucker is delayed somewhat with respect to the starting timing (point 165) of the cop hanging arm 29 and the chucker 54 and the cop hanging arm 29 are raised at the same speed, and hence the cops are gripped by the grippers 30 while the cop hanging arms are raised.

(b) Starting yarn end unwinding process

The cop gripped by the gripper 30 and suspended from the cop hanging arm 29 at the cop chucking position A is transferred to the position B shown in FIG. 5 through the turning of the cop hanging arm 29 through an angle of 45°. At the position B, the lower end of the cop enters the cylinder 80 of the starting yarn end sucking pipe, as illustrated in FIG. 7, as the cop hanging arm descends. With the cop thus located, the cop is rotated in the starting yarn end unwinding direction by the action of the touch roller 147 (FIG. 16) while the starting yarn end Y6 is unwound by the action of the stream of fluid jetted by the nozzle 79 (FIG. 7). Then, the yarn end Y7 is sucked into the suction pipe and the cutter 83 is actuated to shorten the unwound yarn end as a yarn end Y8 illustrated by two dotted and chain line. When the yarn end is cut, the suction is interrupted immediately and the starting yarn end unwinding process is finished.

(c) Tangled yarn cutting process

The tangled yarn cutting mechanism 61 shown in FIGS. 10 and 11 operates at the position C (FIG. 5), where the lower end of the cop is located by a cop supporting member 168 shown in FIG. 6. The construction of the cop supporting member 168 is practically the same as the cop supporting member 137 shown in FIG. 15, except that the cop supporting member 168 is not provided with the central through hole 136 for suction air. Tangled yarn is cut also while the cop is turned in the yarn end unwinding direction by the action of the touch roller. The yarn ends Y1 and Y2 of a cop located in front of the cover 107 is sucked into the suction pipe 93 through the opening 108 and is cut by the cutter 96 disposed at the opening. The cutter 96 operates quickly to shorten the finished end yarn Y2 to the shortest possible length, to cut the tangle so that the finished end yarn Y2 and the starting yarn end Y1 are separately surely and to cut the starting yarn end Y1 to a fixed length facilitating the suction of the yarn end Y1 into the suction mouth in the next process.

(d) Yarn end inserting process

At the position D angularly spaced from the position A by an angle of 135°, a cop is supported at the lower end thereof as shown in FIG. 15, while the touch roller 149 (FIG. 16) rotates the cop in the direction of the arrow 169 and the beater 143 is rotated in the direction of the arrow 170 to separate the yarn end positively from the surface of the cop. The yarn end adjusted to a fixed length is sucked into the suction mouth 110. With the yarn end sucked in and held by the suction mouth 110, the suction mouth 110 is transferred to a position 110*a* illustrated by two dotted and chain lines in FIG. 16 as the swivel arm 146 swivels. At the same time, the touch roller 149 is separated from the corresponding flange. Then, the locating member 160 is turned from a position 160*a* illustrated by two dotted and chain lines to a position illustrated by solid lines, where the locating member 160 engages the pin 52 fixed to the rotary member hanging a cop to stop the rotary member with the opening formed between the fingers located opposite to the cutter 112. Then, the yarn guide 111 is raised from the rest position shown in FIG. 6 to the raised position shown in FIGS. 12 and 13. The yarn Y5 extending between the cop K and the suction mouth 110 is picked up by the guide groove 111*a* and lifted as the yarn guide 111 is raised and the yarn Y5 is guided through the slit 171 of the guide plate 115 to the yarn feeler 113 and the cutter 112. In proper timing in reference to the introduction of the yarn into the cutter, the L-shaped actuator 127 engages the pin 123 of the movable blade 120 turning the movable blade 120 as the yarn guide is raised, to cut the yarn. During the yarn cutting operation, suction is generated within the bobbin of the cop, therefore, the yarn end thus cut is sucked through the opening 53 formed between the fingers (FIG. 4) into the bobbin 22. The yarn end Y is cut by the cutter 112 to a certain length so that the lower end of the yarn end Y as suspended in the bobbin is placed at least above the tip of the peg 21 and that the yarn end as blown upward at a winding unit can reach the relaying pipe waiting above the cop. An excessively long yarn end is liable to be caught between the inner circumference of the bobbin and the outer circumference of the peg in fitting the cop again on the peg, which will cause failure in blowing the yarn end upward at a winding unit. The cut length of the yarn end is set by adjusting the position of the cutter 112 (FIG. 12) and the upper limit position of the yarn guide 111.

The yarn feeler 113 detects whether the yarn end has been readied successfully. When no yarn is detected by the yarn feeler 113, namely, when the yarn end is readied unsuccessfully, the yarn feeler 113 gives a signal to eject the tray with the unsuccessfully readied yarn end from the cop feeding line after discharging the same from the yarn end readying device or to return the cop to the yarn end reading apparatus to subject the cop again to the yarn end readying operation. A gate provided on the cop feeding line is controlled by the signal provided by the yarn feeler, for the selective distribution of the cops.

(e) Cop fitting process

At the exit position E angularly spaced from the entrance position A by an angle of 180°, the cop having the readyed yarn end is fitted again on the tray T waiting at the position E below the cop. While the cop hanging arm 29 and the opener 58 are lowered at the same speed, the cop remains gripped (FIG. 4). During the downward movement of the cop hanging arm 29, the cop is fitted on the peg of the tray and when the cop hanging arm 29 reaches the lower limit position, the cop is fitted perfectly on the peg. In this state, the opener 58 starts moving upward (point 172) prior to the start (point 165) of the cop hanging arm 29 as shown by lines L1 and L3 in FIG. 17. Consequently, the flange 51 attached to the upper end of the wedging rod of the gripper 30 engages the catching part 58*a* of the opener 58 and is pulled up, so that the wedge head 49 escapes from the gripping arms 43*a* and 43*b*, then the gripping arms 43*a* and 43*b* are pulled toward each other by the spring 42, and thereby the fingers 41*a* and 41*b* are opened to release the cop.

After the cop has been released from the gripper, the cop hanging arm 29 and the opener 58 are raised at the same speed leaving the cop on the tray to complete the cop fitting process.

The cops thus processed through the processes (A) through (E) and each having the starting yarn end suspended within the bobbin are released from the stopping mechanism 63 shown in FIG. 5 and are transported to the automatic winder.

What is claimed is:

1. In a system in which cops having yarn wound around hollow core bobbins are conveyed on carriers, a device for readying a starting end of said yarn for delivery to a winder comprising:

cop hanging means for removing each of said cops from its respective carrier and refitting said cop onto said carrier;

starting yarn end unwinding and cutting means for unwinding said starting yarn end from said cop and cutting said unwound starting yarn end, tangled yarn cutting means for separating said starting yarn end from said yarn wound on said cop; and yarn end inserting means for inserting said starting yarn end into the hollow core of said bobbin;

wherein said starting yarn end unwinding and cutting means, said tangled yarn cutting means and said yarn end inserting means are arranged sequentially.

2. A device as in claim 1, wherein said cop hanging means further comprises a vertical shaft, a plurality of cop hanging arms extending radially from said shaft, each of said arms having cop gripping means for gripping said cops, rotary drive means for intermittently rotating said shaft and vertical drive means for vertically displacing said shaft.

3. A device as in claim 2, wherein said cop gripping means further comprises a rotary member having a bore therethrough and a pair of gripping arms, said gripping arms being biased by a first spring to move toward each other, a wedge rod disposed in said bore of said rotary member, said wedge rod being biased downward by a second spring, said gripping arms having fingers at the lower end thereof, said fingers forming a yarn end inserting opening.

4. A device as in claim 1, wherein said starting yarn end unwinding and cutting means further comprises a starting yarn end sucking pipe, a cylinder disposed above said sucking pipe, said cylinder having a cop receiving hole and a fluid jet nozzle, said fluid jet nozzle being positioned to jet a fluid along a line substantially tangent to the circumference of said cop to thereby unwind said starting yarn end, and a cutter having a movable blade which swivels across said starting end sucking pipe and a stationary blade, said cutter being disposed between said sucking pipe and said cylinder.

5. A device as in claim 1, wherein said tangled yarn cutting means further comprises a suction pipe situated adjacent to the lower end of said cop, a cutter having a movable blade capable of reciprocating across the opening of said suction pipe, and a fixed blade disposed adjacent the opening of said suction pipe, whereby the tangled portion of said starting yarn end and said yarn wound on said cop is sucked into said suction pipe and cut off by said cutter.

6. A device as in claim 1, wherein said yarn end inserting means further comprises a suction mouth adapted to move toward and away from the surface of said yarn wound on said cop, a yarn guide for holding and lifting said yarn end extending between said cop and said suction mouth, a cutter for cutting said lifted starting yarn end to a certain length, a yarn feeler, and a yarn end sucking mechanism for generating an air stream to suck said cut starting yarn end into the hollow core of said bobbin.

7. A device as in claim 6, wherein said yarn end sucking mechanism further comprises a suction cylinder, a cop supporting member having a central through hole, said cop supporting member being rotatably and vertically movable within said suction cylinder, said cop supporting member having a cone-shaped upper end, said cone-shaped upper end of said cop supporting member entering the hollow core of said bobbin to support said bobbin and to cause a suction air stream within the hollow core of said bobbin.

8. A device as in claim 1, wherein said yarn end inserting means further comprises a beater to facilitate separating the yarn end from the yarn layer of said cop.

9. A device as in claim 2, further comprising a rotating mechanism for rotating said cops in a yarn end unwinding direction is provided in the starting yarn end unwinding and cutting means, the tangled yarns cutting means and the yarn end inserting means, said rotating mechanism including a swivel arm mounted pivotally on a shaft fixed to a frame, a plurality of touch rollers rotatably mounted on the lower side of said swivel arm, and a driving member for said touch rollers, said touch rollers being able to come to frictional contact with flanges or rotary members provided on said cop hanging arms.

10. In a system in which cops comprising yarn wound around hollow core bobbins are transported on individual carriers, a device for readying a yarn end for delivery to a winder comprising:

cop removing means for removing said cops from their respective carriers, yarn end unwinding means for unwinding said yarn end from said yarn wound around said bobbin, yarn end disentangling means for disentangling said unwound yarn end from said yarn wound around said bobbin, yarn end cutting means for cutting said yarn end to a length such that said yarn end will not interfere with said carrier upon insertion of said yarn end into said hollow core of said bobbin, yarn end inserting means for inserting said cut yarn end into said hollow core of said bobbin, and cop refitting means for refitting each of said cops onto its respective carrier.

* * * * *